US008092239B2

(12) United States Patent
Nishiyama

(10) Patent No.: US 8,092,239 B2
(45) Date of Patent: Jan. 10, 2012

(54) SUBSTRATE FIXING MEMBER AND ELECTRONIC DEVICE

(75) Inventor: Takeshi Nishiyama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/567,109

(22) Filed: Sep. 25, 2009

(65) Prior Publication Data

US 2010/0081296 A1 Apr. 1, 2010

(30) Foreign Application Priority Data

Sep. 30, 2008 (JP) ..... 2008-253925

(51) Int. Cl.
*H01R 13/62* (2006.01)

(52) U.S. Cl. ..... 439/157; 439/327; 439/159

(58) Field of Classification Search ..... 439/159, 439/157, 327
See application file for complete search history.

(56) References Cited

U.S. PATENT DOCUMENTS

| | | | | |
|---|---|---|---|---|
| 5,051,101 | A * | 9/1991 | Komatsu | 439/159 |
| 5,957,708 | A * | 9/1999 | Lin | 439/157 |
| 7,207,815 | B1 * | 4/2007 | Ju | 439/159 |
| 7,500,863 | B2 * | 3/2009 | Ringler et al. | 439/327 |

FOREIGN PATENT DOCUMENTS

| | | |
|---|---|---|
| JP | 7-35325 | 8/1995 |
| JP | 8-148223 | 6/1996 |
| JP | 2002-75540 | 3/2002 |
| JP | 2002-522874 | 7/2002 |
| WO | WO 00/08589 | 2/2000 |

* cited by examiner

*Primary Examiner* — Truc Nguyen
(74) *Attorney, Agent, or Firm* — Staas & Halsey LLP

(57) ABSTRACT

A substrate fixing member that fixes a first substrate having an insertion hole into which a second substrate having mutually opposing an end portion is to be inserted, the substrate fixing member including a fixing member main body portion that covers a top surface portion of a connector having the insertion hole and has a through-hole which the substrate is to be passed through and a substrate support portion having a groove portion slidably holding an end portion of the substrate when the substrate is passed through the through-hole and the insertion hole to connect a substrate-side connection terminal to a connector-side terminal.

9 Claims, 17 Drawing Sheets

SUBSTRATE FIXING MEMBER AND ELECTRONIC DEVICE

CROSS-REFERENCE TO RELATED APPLICATION

This application is based upon and claims priority to prior Japanese Patent Application No. 2008-253925 filed on Sep. 30, 2008 in the Japan Patent Office, the entire contents of which are incorporated herein by reference.

FIELD

Various embodiments described herein relate to a substrate fixing member and an electronic device.

BACKGROUND

In general, an electronic device includes a plurality of substrates. Each of the substrates is connected to a respective one of the other substrates via a connection component such as a connector. In this case, for example, conductive contacts are arranged on the surface of an end portion of each of the substrates. In the connector, there is provided a groove portion for receiving the substrate end portion, and on the inner wall of the groove portion, there are provided contacts on the connector side to make contact with the contacts of the substrate. By inserting the substrate end portion into the groove portion of the connector, the contacts on the substrate make contact with the contacts in the connector groove portion, thereby establishing the electrical connection therebetween. In this case, as falling-off prevention provided between the substrate and the connector (hereinafter, referred to as a "falling-off prevention structure"), the following arrangements have hitherto been provided.

FIG. 1 depicts an example of first falling-off prevention structure. The first falling-off prevention structure is a type without any coming-off prevention mechanism between a substrate 301 and a connector 401. Hereinafter, the substrate is also referred to as a "module", and the connector is also referred to as a "socket".

In the example depicted in FIG. 1, an end portion of a substrate 301 is arranged in a groove portion (not depicted) of a connector 401. In FIG. 1, the falling-off prevention is achieved by a pressing force by elasticity of each of the material of the substrate 301 and the connector 401, by a fitting force between the end portion of the substrate 301 and the groove portion of the connector 401, or by a frictional force between the end portion of the substrate 301 and the groove portion of the connector 401 at the time when the end portion of the substrate 301 is inserted into the groove portion of the connector 401. However, in the first falling-off prevention structure, when an external force, oscillation, shock or the like exceeding the pressing force, the fitting force, or the frictional force acts on the first falling-off prevention structure, the connector 401 would fall off from the substrate 301 due to disturbance such as the external force, oscillation, shock, or the like.

FIG. 2 depicts a second falling-off preventing structure. In the second falling-off preventing structure, coming-off prevention mechanism 413 is provided to a connector 411. The coming-off prevention mechanism 413 has a locked state wherein the connection portion between a substrate 311 and the connector 411 is locked, and a released state wherein the connection portion is unlocked. In FIG. 2, the position of each of the coming-off prevention mechanisms 413 in the locked state is indicated by solid lines while the position of the coming-off prevention mechanism 413 in the released state is indicated by a dotted line. As depicted in FIG. 2, in order to ensure an operation space D410, no other members can be disposed within the movable range of the coming-off prevention mechanism 413. Therefore, the construction depicted in FIG. 2 requires operation spaces D410 for releasing the coming-off prevention mechanism 413, and so this operation space D410 becomes an obstacle to high-density mounting.

FIG. 3 depicts a third falling-off preventing structure. The third falling-off preventing structure is a structure for fixing a connector 421 and a substrate 321 to be connected to the connector 421 by a coming-off prevention mechanism 423 (the third falling-off preventing structure is also referred to as a "module holding member"). The coming-off prevention mechanism 423 is fixed to a mating substrate 490 (mother board or the like), which is a connection destination to which the substrate 321 is connected via the connector 421. In FIG. 3, the mating substrate 490 is only partly illustrated, a boundary line between the illustrated part and an omitted part is represented by a dotted line. As in the case of FIG. 3, also in drawings hereinafter, omitted parts are each represented by a curved dotted line. Meanwhile, in order to add a coming-off prevention mechanism to such a structure of which the connector or substrate has no coming-off prevention mechanism in itself, it is necessary to provide a large-scale coming-off prevention mechanism on the substrate. Also in this structure, therefore, there occurs a problem of an occupied space. This is because the coming-off prevention mechanism 423 is fixed to the substrate 490 that mounts the connector 421 thereto. Furthermore, in the structure depicted in FIG. 3, if wind of a cooling mechanism for example a fan, or the like flows thereinto from a direction indicated by an arrow A320, effects of the coming-off prevention mechanism 423 upon the cooling operation presents a problem. Another problem in the structure depicted in FIG. 3 is that, in order to apply this structure to modules mutually different in height or the like, special designs for each module are needed.

[Patent Document 1] Japanese Laid-open Patent Publication No. 08-148223

[Patent Document 2] Published Japanese translation of a PCT application No. 2002-522874

[Patent Document 3] Japanese Registered Utility Model Publication No. 7-35325

[Patent Document 4] Japanese Laid-open Patent Publication No. 2002-75540

SUMMARY

A substrate fixing member that fixes a first substrate having an insertion hole into which a second substrate having a mutually opposing end portion is to be inserted, the substrate fixing member including a fixing member main body portion that covers a top surface portion of a connector having the insertion hole and has a through-hole that the substrate is to be passed through and a substrate support portion having a groove portion slidably holding an end portion of the substrate when the substrate is passed through the through-hole and the insertion hole to connect a substrate-side connection terminal to a connector-side terminal.

DESCRIPTION OF EMBODIMENTS

Figure 1:
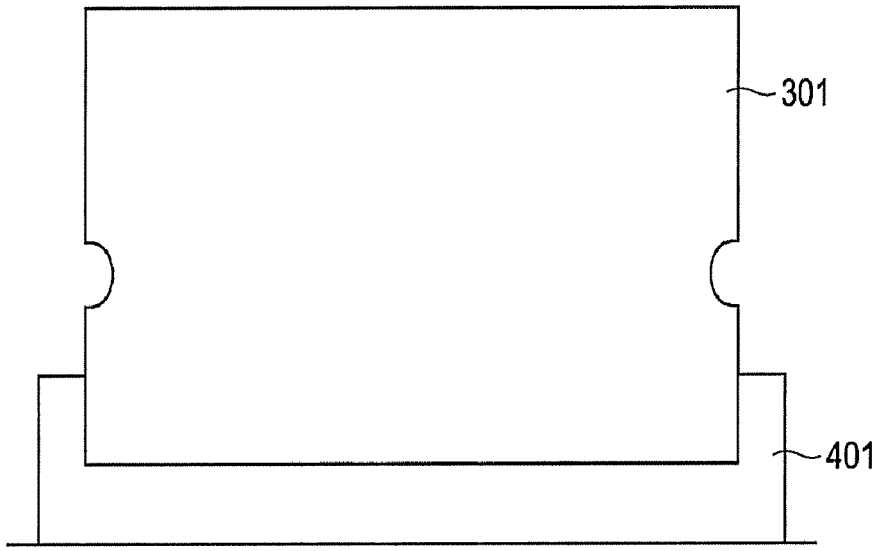
FIG. 1 is a diagram depicting an example of a first falling-off prevention structure.
Figure 2:
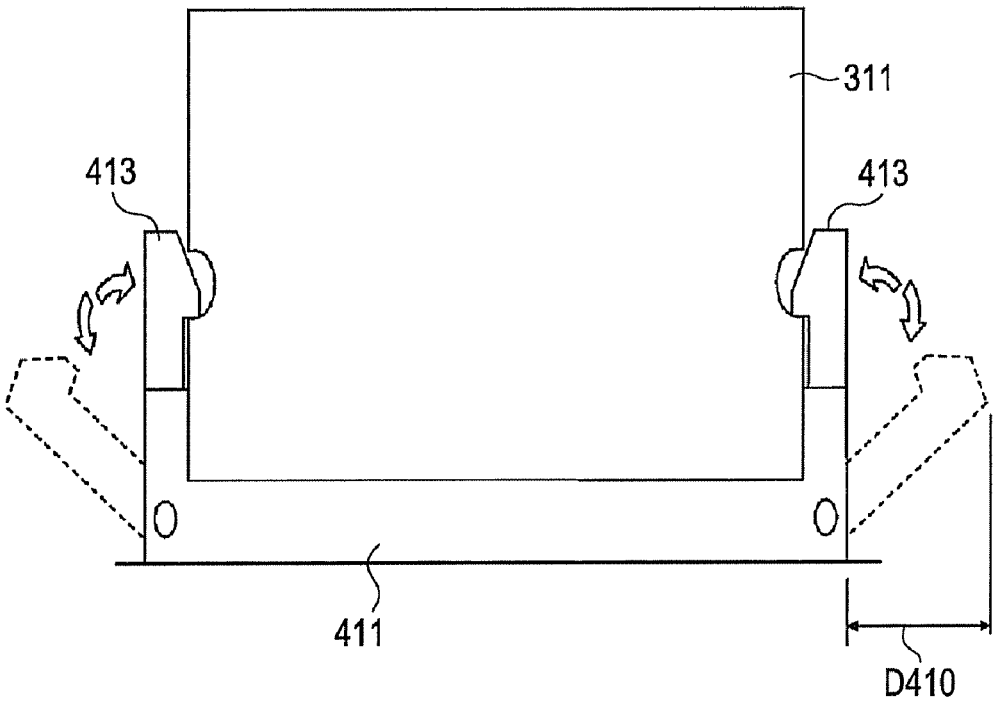
FIG. 2 is a diagram depicting an example of a second falling-off prevention structure.
Figure 3:
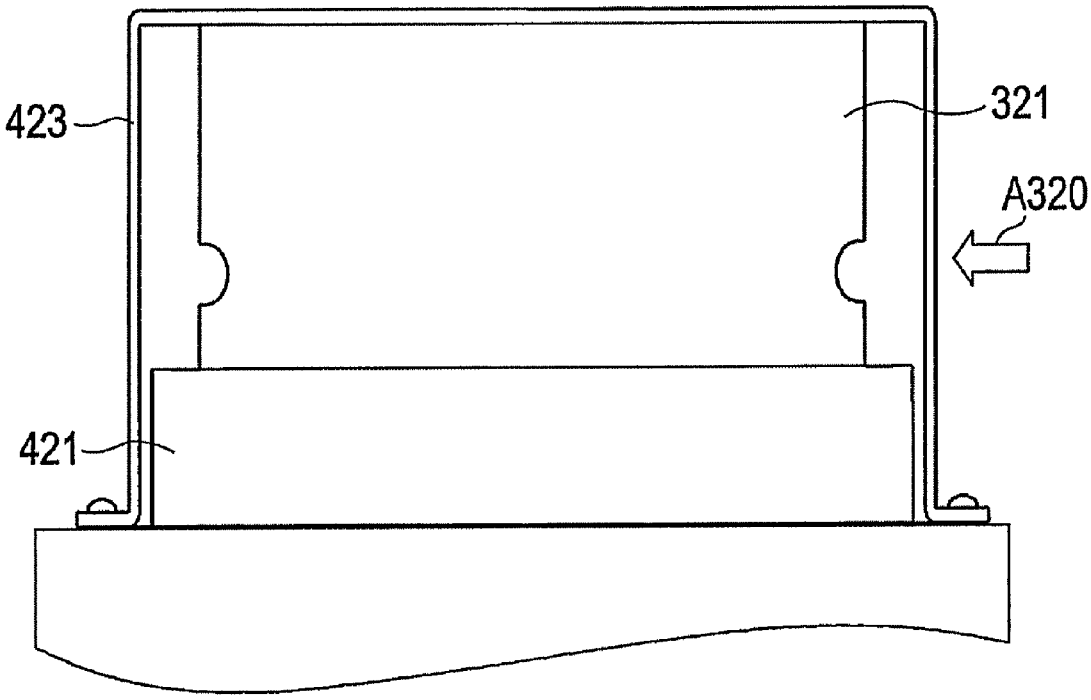
FIG. 3 is a diagram depicting an example of a third falling-off prevention structure.

Hereinafter, an electronic device according to disclosed embodiments (hereinbelow, simply referred to as "embodiments") will be described with reference to the accompanying drawings. In the following description, the same or equivalent components are denoted by the same reference characters, and a description thereof is omitted. This electronic device includes substrates, a connector (also referred to as a "card edge connector") connecting a substrate and the other substrate, and a falling-off prevention device. The following constructions of the embodiments are simply exemplary, and this disclosed art is not limited to the constructions of the embodiments.

Figure 4:
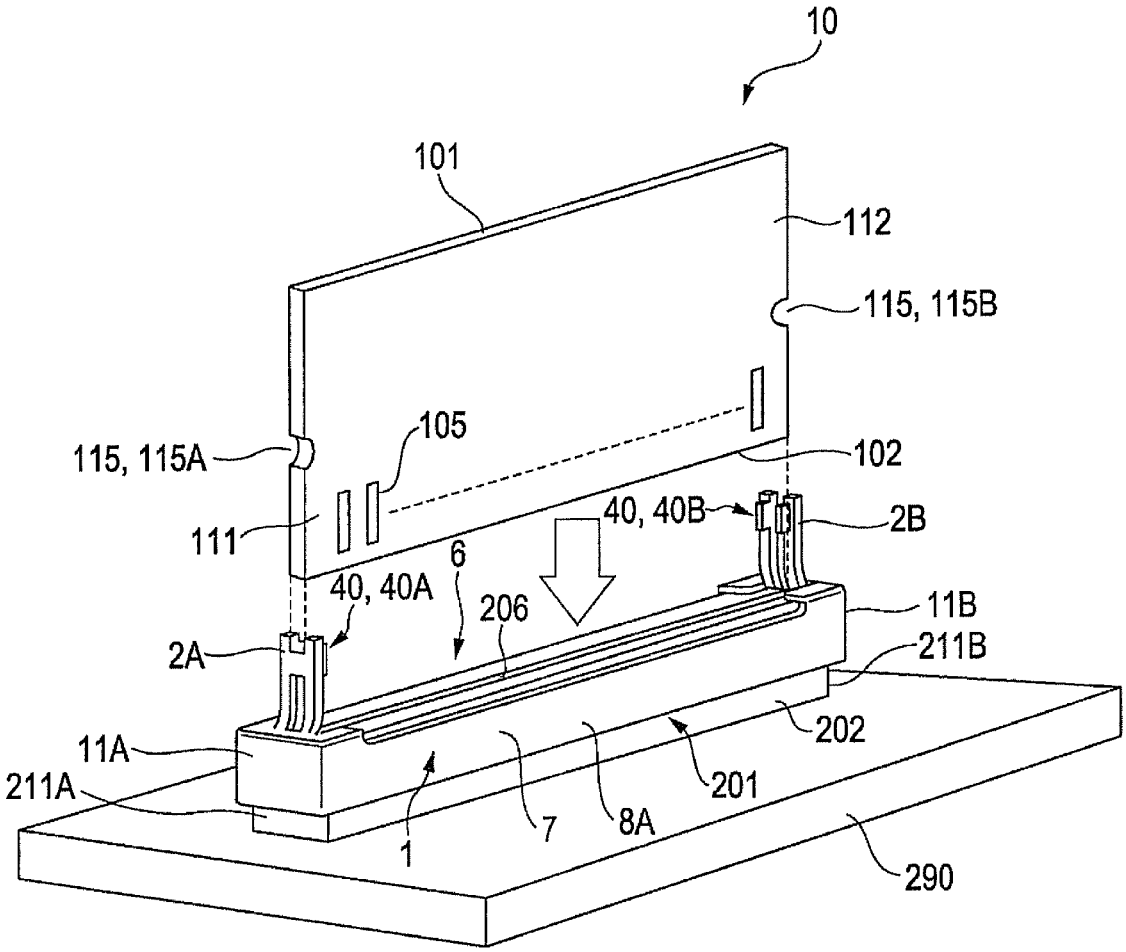
FIG. 4 is a diagram depicting an example of a schematic configuration of an electronic device.

An electronic device 10 according to a first embodiment is described with reference to FIG. 4 to FIGS. 9A to 9C. FIG. 4 depicts the schematic construction of the electronic device 10. The electronic device 10 includes a first substrate 290, a connector 201 mounted to the first substrate 290, a second substrate 101 to be connected to the first substrate 290 by the connector 201, and a falling-off prevention device 1 (corresponding to a substrate fixing member) for preventing the connector 201 from falling off between the first substrate 290 and the second substrate 101.

A large number of electronic devices (not depicted) are arranged on the first substrate 290, and these electronic devices are each connected to a respective one of the electronic devices by a conductive pattern. The conductive patterns are connected to contacts formed at an edge of the first substrate 290. By the edge on the first substrate 290 being inserted into a groove portion formed in the lower-end surface of the connector 201 in FIG. 4 (not depicted in FIG. 4), the contacts on the side of the first substrate 290 make contact with the contacts on the side of the connector 201 in the groove. One example of the first substrate 290 is a substrate referred to as "mother board".

As in the case of the first substrate 290, on the second substrate 101, there are provided a large number of electronic devices (not depicted), which are each connected to a respective one of the electronic devices by a conductive pattern. The conductive patterns are connected to a plurality of contacts 105 (corresponding to substrate-side terminals; partly omitted in FIG. 4) formed in the vicinity of a lower-side edge 102 of the second substrate 101. Hereinafter, the upper, lower, left, and right sides relative to shapes depicted in drawings refers to the upper, lower, left, and right sides when respective drawings are viewed from the front side. The lower-side edge 102 on the second first substrate 101, by being inserted into a groove portion 206 (corresponding to an insertion hole) on the top surface of the connector 201, makes contact with contacts 205 (refer to FIGS. 7A and 7B; corresponds to the connector-side terminal) on the side of the connector 201 on the groove portion 206. An example of the second substrate 101 is a substrate being referred to as a module, and adding various functions to the electronic device 10.

Left and right side portions of the second substrate 101 are respectively referred to as a first end portion 111 and a second end portion 112. The first end portion 111 and the second end portion 112 respectively have notch portions 115A and 115B. When the notch portions 115A and 115B are not distinguished from each other, they are generically named "notch portion 115".

Figure 5:
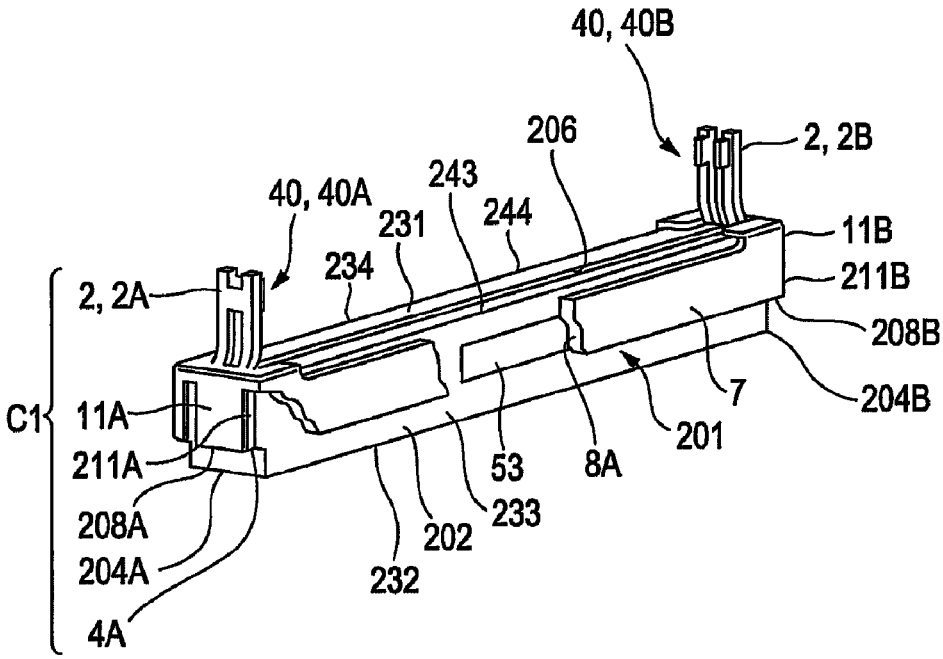
FIG. 5 is a perspective view of the electronic device with the substrate removed.

The connector 201 has a boxy housing 202 (corresponding to a main body portion of the connector). FIG. 5 is a perspective view illustrating the electronic device 10 with the first substrate 290 and the second substrate 101 removed. As depicted in FIG. 5, the housing 202 has a substantially rectangular parallelepiped shape. Out of the outer surface of the housing 202, a surface facing the second substrate 101 is referred to as a "top surface 231" (corresponding to a top surface portion). In the top surface 231 of the connector 201, there is provided a groove portion 206 for receiving the lower-side edge 102 of the second substrate 101 (for details, refer to FIGS. 7A and 7B).

Furthermore, out of the outer surface of the housing 202, a surface opposed to the top surface 231, that is, a surface to be mounted on the first substrate 290 is referred to as a "bottom surface 232". On the other hand, out of the outer surface of the housing 202, surfaces other than the top surface 231 and the bottom surface 232 are referred to as "side surfaces". Out of the side surfaces, a surface that extends in the longitudinal direction of the groove portion, i.e., a surface parallel to lower-side edge 102, and a surface on the front side in FIGS. 4 and 5, is referred to as a "first long side surface 233". On the other hand, out of the outer surface of the housing 202, a side surface on the side (back side in FIGS. 4 and 5) opposite to the first long side surface 233 is referred to as a "second long side surface 234". Moreover, out of the side surfaces, surfaces that are substantially orthogonal to the first long side surface 233 and the second long side surface 234, and that are located on both sides of each of the first long side surface 233 and the second long side surface 234 in FIGS. 4 and 5 are referred to as a "first short side surface 211A" (left side toward the first long side surface 233 in FIG. 4) and a "second short side surface 211B" (right side toward the first long side surface 233 in FIG. 4), respectively.

Figure 7A:
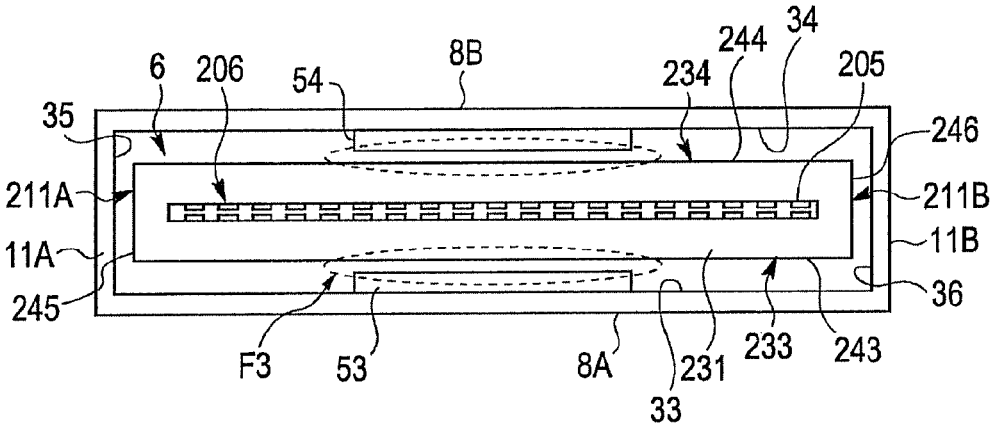
FIG. 7A is a diagram depicting an example of problem in the time of fixing operation.
Figure 7B:
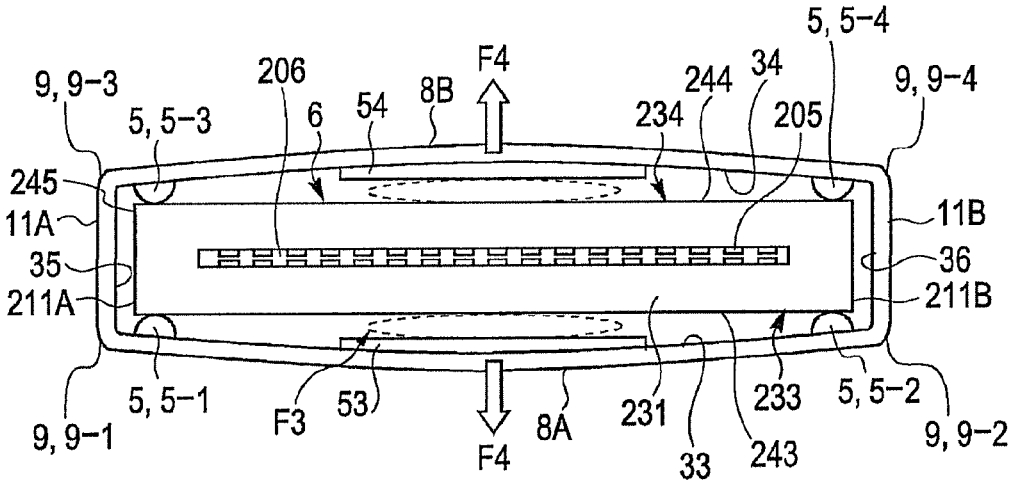
FIG. 7B is a diagram depicting examples of inventive approaches to smooth the fixing operation.

A side formed at a corner portion shared between the top surface 231 and the first long side surface 233 is referred to as a "first long side 243", while a side formed at a corner portion shared between the top surface 231 and the second long side surface 234 is referred to as a "second long side 244". Furthermore, as depicted in FIGS. 7A and 7B, a side formed at a corner portion shared between the top surface 231 and the first short side surface 211A is referred to as a "first short side 245", while a side formed at a corner shared between the top surface 231 and the second short side surface 211B is referred to as a "second short side 246".

The falling-off prevention device 1 includes a boxy base portion 7 (corresponding to the main body of the fixing member) in contact with the outer surface of the connector 201, and columnar portions 2A and 2B (corresponding to first and second substrate support portions, respectively) that erect from both ends of the base portion 7 toward the direction of the second substrate 101. Hereinafter, when the columnar portion 2A and 2B are not distinguished from each other, they are generically named "columnar portion 2". Out of the outer surface of the boxy base portion 7, a side covering the top surface of the connector 201 is referred to as a "top surface". On the other hand, a surface opposed to the top surface of the base portion 7 is referred to as a "bottom surface". In the base portion 7, there is provided an opening 6 (corresponding to a through-hole) penetrating from the top surface down to the bottom surface. Such a falling-off prevention device 1 can be produced, for example, by molding resin.

On the other hand, out of the outer surface of the base portion 7, portions other than the top surface and the bottom surface are referred to as "side surfaces". Out of the side surface, surfaces that extend in the longitudinal direction of the opening 6, i.e., surfaces parallel to the lower-side edge of the second substrate 101, a surface on the front side in FIG. 4, is referred to as a "front side portion 8A" (corresponding to the first long side surface), while a surface on the back side in FIG. 4, is referred to as a "back side portion 8B" (corresponding to the second long side surface). Moreover, out of the side surface, surfaces that are substantially orthogonal to the front side portion 8A and the back side portion 8B, and that are located on both sides of each of the front side portion 8A and the back side portion 8B in FIG. 4 are referred to as a "side portion 11A" (left side toward the front side portion 8A in FIG. 4) and a "side portion 11B" (right side toward the front side portion 8A in FIG. 4), respectively. Corner portions shared between: the front side portion 8A and the side portion 11A; the side portion 11A and the back side portion 8B; the back side portion 8B and the side portion 11B; and the side portion 11B and the front side portion 8A are respectively referred to as corner portions 9-1, 9-2, 9-3, 9-4 (refer to FIG. 7A). When the corner portions 9-1, 9-2, 9-3, 9-4 are not distinguished from one another, they are generically named "corner portion 9".

Because of the structures for receiving the first substrate 290 and the second substrate 101, the top surface and the bottom surface of the connector 201 each has a narrow strip shape that is long in the direction of the upper-side edge of the first substrate 290 and the lower-side edge 102 of the second substrate and that is short in the direction intersecting these edges. In the vicinity of both ends of the narrow strip shaped top surface, there are provided columnar portions 2A and 2B.

On the top surface of the base portion 7 of the falling-off prevention device 1, an opening 6 is arranged between the columnar portions 2A and 2B. The opening 6 penetrates the base portion 7 from the top surface down to the bottom surface. Accordingly, when the opening 6 is viewed from above the falling-off prevention device 1 in FIG. 4, the groove portion 206 of the connector 201 is exposed. Therefore, the lower-side edge 102 of the second substrate 101 can be inserted into the opening 6 of the falling-off prevention device 1 and the groove portion 206 of the connector 201.

On the opposed surfaces of the columnar portions 2A and 2B, respectively, projecting portions 40A and 40B are provided. Hereinafter, when the projecting portions 40A and 40B are not distinguished from each other, they are generically named "projecting portion 40". When the lower-side edge 102 of the second substrate 101 is inserted into the opening 6 of the falling-off prevention device 1 and the groove portion 206 of the connector 201, the first end portion 111 and the second end portion 112 of the of the second substrate 101 respectively slide against the opposed surfaces of the columnar portion 2A and the columnar portion 2B. When the lower-side edge 102 of the second substrate 101 is mounted to the connector 201, the projecting portions 40A and 40B of the columnar portions 2A and 2B are fitted into the notch portions 115A and 115B, respectively. The projecting portion 40 each maintains a state of being engaged in the notch portions 115A and 115B.

FIG. 5 further depicts examples of methods for fixing the falling-off prevention device 1 and the connector 201. Here, two fixing methods are depicted as examples, but it does not mean that the two fixing methods must be used in combination. That is, either one of them may be implemented, or the two may be used in combination.

In a first method, the falling-off prevention device 1 is fixed to the connector 201 using an adhesive or adhesive tapes (hereinafter, referred to as "adhesive members 53 and 54"). A perspective view and plan views depicting this situation are depicted in FIG. 5, and FIGS. 7A and 7B, respectively. As depicted in FIGS. 7A and 7B, an adhesive 53 is adhered to an inner wall 33 (corresponding to a first inner wall surface), which is the back surface of the front side portion 8A of the falling-off prevention device 1. On the other hand, an adhesive 54 is adhered to an inner wall 34, which is the back surface of the back side portion 8B of the falling-off prevention device 1. As depicted in FIG. 5, when the falling-off prevention device 1 is caused to cover the connector 201, the adhesive 53 adheres to the first long side surface 233 of the connector 201. Likewise, the adhesive 54 adheres to the inner wall 34 (corresponding to a second inner wall surface), which is the back surface of the back side portion 8B of the falling-off prevention device 1. When the falling-off prevention device 1 is caused to cover the connector 201, the adhesive 54 adheres to the second long side surface 234 of the connector 201.

In a second method, claws are provided to parts of the falling-off prevention device 1, and by engaging the claws with the connector 201, the falling-off prevention device 1 is fixed to the connector 201. In the example in FIG. 5, at a corner portion 204A constituting a boundary between the bottom surface 232 of the housing 202 of the connector 201, and the first short side surface 211A, there is provided a level difference 208A (corresponding to a first engagement receiving portion) having a shape formed by cutting off the corner portion 204A. Likewise, at a corner portion 204B constituting a boundary between the bottom surface 232, and the second short side surface 211B, there is provided a level difference 208B (corresponding to a second engagement receiving portion) having a shape formed by cutting off the corner portion 204B by two mutually orthogonal surfaces. On the opposed side portions 11A and 11B of the base portion 7 in the falling-off prevention device 1, there are provided claw portions 4A and 4B (corresponding to first and second engagement portions, respectively). The claw portions 4A and 4B project toward the direction in which they mutually approach from the opposed side portions 11A and 11B of the base portion 7. Here, in FIG. 5, the claw portions 4A and 4B are formed to be bent toward the direction in which they mutually approach from the opposed side portions 11A and 11B of the base portion 7.

However, the claw portions 4A and 4B themselves have only to be formed on the inner wall surface of the base portion 7. That is, an inner wall 35 (corresponding to a third inner wall surface) opposed to the first short side surface 211A of the connector 201 has only to be a bent inner wall to thereby form an engagement portion so as to engage with the level difference 208A. Likewise, an inner wall 36 (corresponding to a fourth inner wall surface) opposed to the second short side surface 211B of the connector 201 has only to be a bent inner wall to thereby form an engagement portion so as to engage with the level difference 208B (regarding the inner walls 35 and 36, refer to FIG. 7A; in FIG. 7A, the engagement portions are omitted). In this way, upon being mounted to the falling-off prevention device 1, the claw portions 4A and 4B respectively engage with the level differences 208A and 208B formed in the housing 202 of the connector 201.

Figure 6:
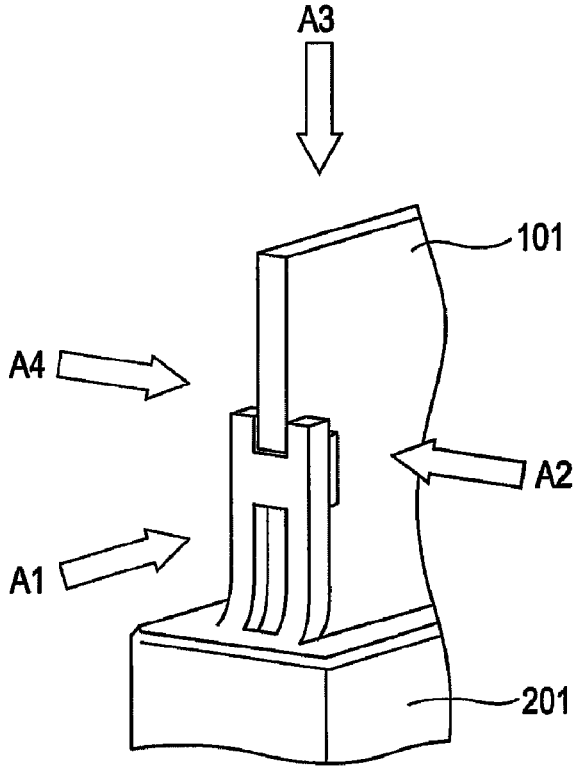
FIG. 6 is a diagram defining diagrammatically indicated directions.

In FIG. 6, diagrammatically-indicated directions for explaining in detail the electronic device 10, especially the falling-off prevention device 1, are defined. FIG. 6 is an enlarged diagram of a portion encircled by a bracket C1 depicted in FIG. 5. First, when the second substrate 101 is inserted into the falling-off prevention device 1, a direction in which the side of the second substrate 101 is viewed, sliding against the columnar portion 2, that is, a direction in which the side of the second substrate 101 is viewed from the outer surface of the columnar portion 2 is taken as a diagrammatically-indicated direction A1. Furthermore, when the second substrate 101 is inserted into the falling-off prevention device 1, a direction in which one surface of the substrate is viewed from the front side is taken as a diagrammatically-indicated direction A2 (i.e., a direction in which the columnar portion 2 is viewed from the right front). On the other hand, opposite to the diagrammatically-indicated direction A2, a direction in which the back surface side is viewed is taken as a diagrammatically-indicated direction A4. Moreover, a direction in which the falling-off prevention device 1 is viewed from the direction of the second substrate (i.e., a direction in which the top surface of the falling-off prevention device 1 is viewed) is taken as a diagrammatically-indicated direction A3.

FIGS. 7A and 7B depict examples of inventive approaches for smoothing fixing operations when fixing the falling-off prevention device 1 to the columnar portion 201 using the adhesives 53 and 54. FIGS. 7A and 7B are each a diagram at the time when the falling-off prevention device 1 and the connector 201 covered therewith are viewed from the direction A3 (i.e., the side of the top surface 231 of the connector 201, and the top surface side of the falling-off prevention device 1).

As depicted in FIG. 7A, in the above-describe first method, adhesive members 53 and 54 are supplied into a space between the outer surface of the housing 202 in the connector 201 and the inner wall of the falling-off prevention device 1. In this method, however, it is assumed that the adhesive members 53 and 54 adhere to the outer surface of the connector 201 in the process wherein the connector 201 is covered with the falling-off prevention device 1, that is, in the process where the housing 202 of the connector 201 is inserted into the falling-off prevention device 1, the adhesive members 53 and 54 may adhere to the outer surface of the connector 201. This is because, as depicted in FIG. 7A, the side wall of the housing 202 of the connector 201 and the inner wall of the falling-off prevention device 1 are located close to each other with a narrow space (portion F3) therebetween, so that the adhesive members 53 and 54 are prone to make contact with the side wall of the housing 202 of the connector 201 in the insertion process.

This being the case, in the inner wall of the falling-off prevention device 1, there are provided four projecting portions 5 interfering with the housing 202 of the connector 201. That is, on the back side of the front side portion 8A of the falling-off prevention device 1, i.e., on the inner wall 33 opposed to the first long side surface 233 of the connector 201, at two locations in the vicinity of respective corner portions 9 (9-1 and 9-2), there are provided projecting portions 5-1, and 5-2, respectively (each corresponding to a first interference portion). Likewise, on the back side of the front side portion 8A of the falling-off prevention device 1, i.e., on the inner wall 34 opposed to the second long side surface 234 of the connector 201, at two locations in the vicinity of respective corner portions 9 (9-3 and 9-4), there are provided projecting portions 5-3, and 5-4, respectively (each corresponding to a second interference portion). When the projecting portions 5-1 to 5-4 are not distinguished from one another, they are generically named "projecting portion 5".

As compared with the front side portion 8A and the back side portion 8B parallel to the substrate surface of the second substrate 101, both side portions 11A and 11B are short in length in a section perpendicular to the diagrammatically-indicated direction A3. Therefore, both side portions 11A and 1B of the falling-off prevention device 1 are poor in the flexibility of a material thereof as compared with the front side portion 8A and the back side portion 8B. Accordingly, by being provided with the projecting portion 5, both side portions 11A and 11B of the falling-off prevention device 1 operates in the direction in which the original length is maintained. As a result, in a section perpendicular to the diagrammatically-indicated direction A3 of the falling-off prevention device 1, the corner portion 9 deforms from the 90 degree direction to a direction at an obtuse angle, so that the front side portion 8A and the back side portion 8B deforms to in toward an arrow direction F4. That is, by virtue of the existence of the projecting portions 5, the front side portion 8A and the back side portion 8B of the falling-off prevention device 1 is subjected to an action in a direction in which they lift off from the side wall of the housing 202 of the connector 201. Consequently, a clearance between the side walls (the first long side surface 233 and the second long side surface 234) of the housing 202 and the inner walls 33 and 34 (F3 portion) enlarges. By such an action, in the insertion process where the housing 202 of the connector 201 is inserted into the falling-off prevention device 1, it is possible to reduce a possibility that the adhesive members 53 and 54 adhere to the side walls of the connector 201.

Here, the length of the projecting portions 5 in the direction parallel to the diagrammatically-indicated direction A3 may be, for example, the length from the top surface of the falling-off prevention device 1 to the bottom surface thereof. In other words, the projecting portions 5 may be extended from the inlet of the opening 6 up to the outlet thereof in a columnar manner. Furthermore, the projecting portions 5 may be granular so that the projecting portions 5 project in the direction of the housing 202 of the connector 201 only at the inlet of the opening 6.

Figure 8A:
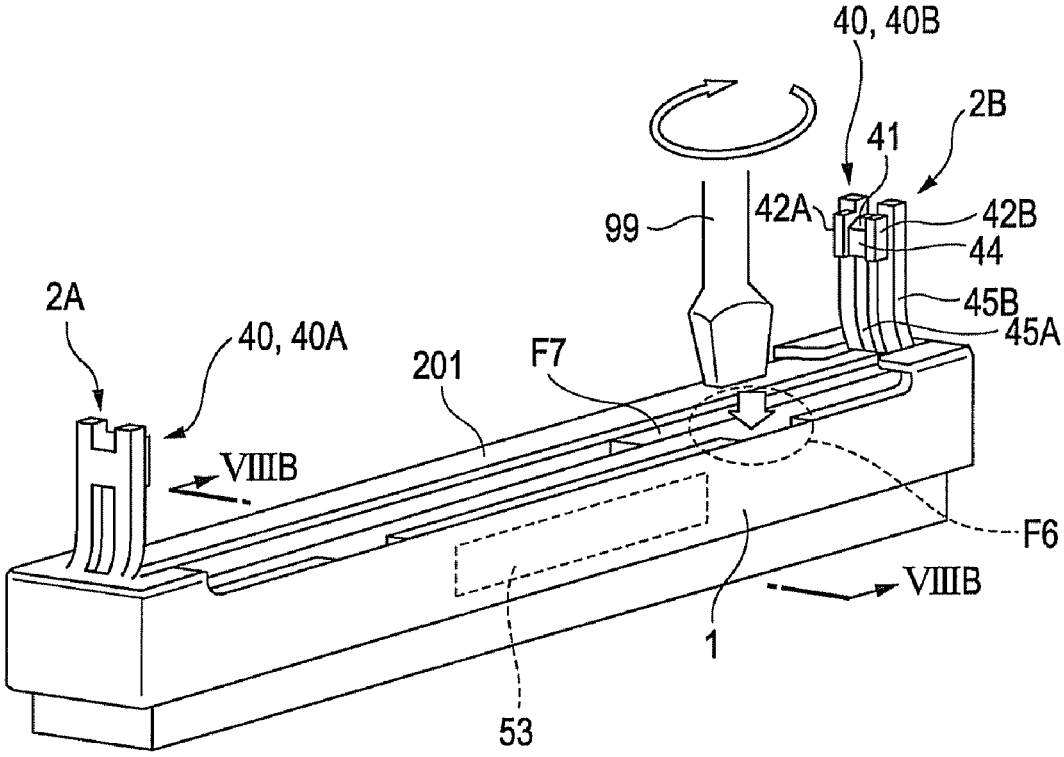
FIGS. 8A and 8B are a perspective view and a sectional view respectively exemplifying a structure for stripping off a portion to which an adhesive member is provided.
Figure 8B:
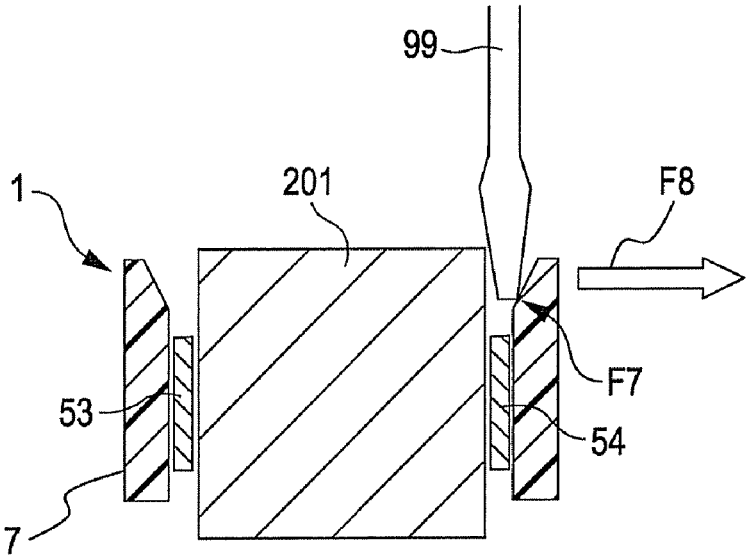

FIGS. 8A and 8B depict an example of structure for stripping off a portion to which the adhesive members 53 and 54 are adhered. Here, assumed is a case where, after the falling-off prevention device 1 has been mounted to the connector 201, there occurs a need to strip off the portion to which the adhesive members 53 and 54 have been adhered because of replacement or the like. In this case, in the present embodiment, the portion to which the adhesive members 53 and 54 have been adhered is stripped off from the connector 201 by inserting a tool 99 of which the tip is flat and thin, such as a flathead screwdriver (hereinafter, referred to as a "tool 99") into the space between the falling-off prevention device 1 and the connector 201 (for example, the F6 portion in FIG. 8A), and twisting the tool 99.

FIG. 8B is a sectional view taken away along a line VIIIB-VIIIB in FIG. 8A. As depicted in FIG. 8B, in the vicinity of the opening 6 of the inner wall surface of the falling-off prevention device 1, there is provided a taper F7. The taper F7 has a shape obtained by obliquely incising the boundary corner portion between inner wall surface and the top surface of the falling-off prevention device 1, or by chamfering the boundary corner portion of the falling-off prevention device 1. Such a shape of the falling-off prevention device 1 allows producing an effect of reducing the occurrence of situations wherein, during an operation to remove the falling-off prevention device 1 from the connector 201, the tool 99 is dropped off from the falling-off prevention device 1, to thereby injure an operator, or damage adjacent components. That is, the tool 99 is guided by the taper F7 and can be easily inserted into the space between the falling-off prevention device 1 and the connector 201. After insertion, the tip of the tool 99 is rotated around the central axis of the tool 99 (i.e., twisted), whereby the side walls constituting the base portion 7 of the falling-off prevention device 1 are moved toward the arrow direction F8, and the adhesive members 53 and 54 on the side walls are stripped off. Such an arrangement enabling the tool 99 to be easily inserted by the taper F7 and allowing the falling-off prevention device 1 to be easily removed, even when, for example, the connector 201 and other components are densely packed to thereby make it impossible to ensure a work space.

FIG. 8A and FIGS. 9A to 9C depict details of the projecting portion 40 of the columnar portion 2. As depicted in FIG. 8A, the projecting portion 40 connects two columnar members 45A and 45B of the columnar portion 2. The columnar portion 2 has a pair of protruding portions 42A and 42B provided in the direction opposed to the sliding surface of the second substrate 101, and a beam member 41 connecting the two columnar members 45A and 45B between protruding portions 42A and 42B. The beam member 41 is sandwiched between the protruding portions 42A and 42B, and forms a groove portion 44 (groove portions of the columnar shaped portions 2A and 2B correspond to first and second groove portions, respectively) receiving the second substrate 101. Accordingly, when the second substrate 101 is inserted into the connector 201 and the falling-off prevention device 1, the sliding surface (side surface in the direction of the substrate thickness) of the second substrate 101 is slid under the guidance of the groove portion 44.

Figure 9C:
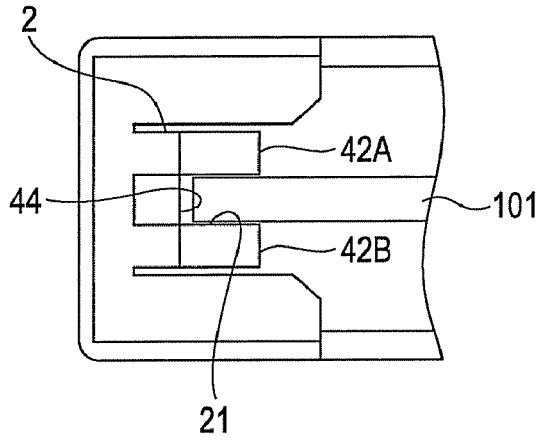
FIGS. 9A, 9B, and 9C are diagrams at the time when a columnar portion according to a first embodiment of the present invention is respectively viewed from diagrammatically-indicated directions A1, A2, and A3.
Figure 9A:
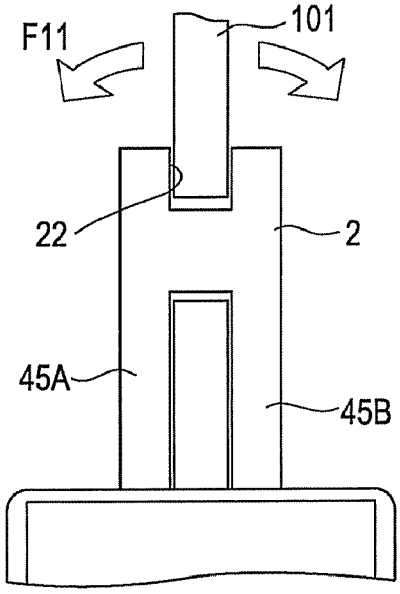
Figure 9B:
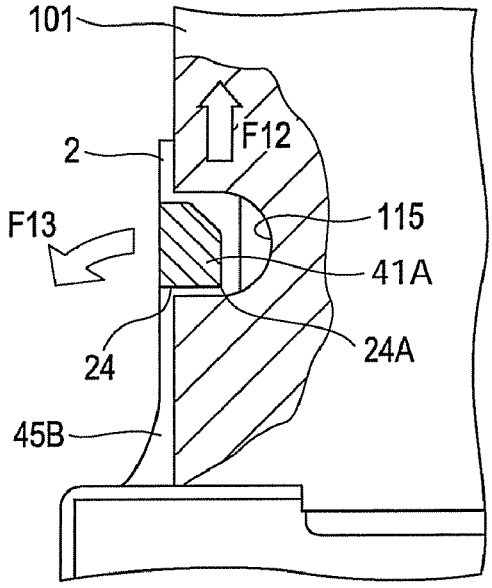

FIGS. 9A to 9C are enlarged views of the portion grouped by bracket C1 depicted in FIG. 5. FIGS. 9A to 9C are figures when the columnar portion 2 is viewed from the diagrammatically-indicated directions A1 to A3, respectively. In the following drawings, portions omitted in partially enlarged views are each indicated by dotted lines including a curve. When the second substrate 101 is mounted to the connector 201, an inner wall 21 having a square U-shape (or a C-shape, a U-shape, or a groove shape formed by combining two L-shape angles) on the side of the groove portion 44 of the protruding portions 42A and 42B slides against the edge portion of the second substrate 101, and function as a guide.

FIGS. 9A and 9B depicts an example of a state where the beam member 41 of the projecting portion 40 is locked by the notch portion 115. As depicted in FIG. 9B, in this embodiment, regarding the shape of the beam member 41A in a section depicted in FIG. 9B perpendicular to the diagrammatically indicated direction A2, the bottom surface 24 thereof is formed flat, and the beam member 41A is in contact with the notch portion 115 at a corner portion 24A. Therefore, even if a force is applied to the second substrate 101 toward the direction in which the falling-off prevention device 1 is pulled downward in FIG. 9B, the falling-off prevention device 1 can not be withdrawn since the corner portion 24A is locked by the notch portion 115. Therefore, the beam member 41A inhibits the second substrate 101 from lifting off in the direction the arrow direction F12. In this case, in order to withdraw the second substrate 101, the columnar portion 2 needs be inclined toward the arrow direction F13 until the corner portion 24A becomes disengaged from the notch portion 115. After the corner portion 24A has been fallen off from the notch portion 115, the second substrate 101 is withdrawn.

Moreover, in a state where the beam member 41A of the projecting portion 40 is locked, inner walls 22 oppositely formed by the two columnar members 45A and 45B of the columnar portion 2 act so as to press the front surface and the back surface of the substrate, respectively. As a result, after the insertion of the second substrate 101 into the falling-off prevention device 1, the inner walls 22 inhibit the second substrate 101 from inclining toward the arrow direction F11.

As described above, in the electronic device 10 according to the present embodiment, the falling-off prevention device 1 is mounted to the connector 201 to be mounted to the first substrate 290. Upon being mounted, as depicted in FIG. 5, the falling-off prevention device 1 is adhered to the outer surface of the connector 201 with the adhesive members 53 and 54 adhered to inner walls of the falling-off prevention device 1. In this time, as depicted in FIG. 7B, the clearance (the F3 portion) between the side walls of the connector 201 and the inner walls of the falling-off prevention device 1 enlarges by providing the projecting portions 5 interfering with the housing 202 of the connector 201 in the vicinity of the side portions 11A and 11B opposed to both side portions of the connector 201 in the inner walls of the falling-off prevention device 1. As a result, in the insertion process where the housing 202 of the connector 201 is inserted into the falling-off prevention device 1, it is possible to reduce a possibility that the adhesive members 53 and 54 adhere to the side walls of the connector 201. Furthermore, after the falling-off prevention device 1 and the connector 201 are once stuck together by the adhesive members 53 and 54, when attempting to remove them, one has only to pry them using the tool 99 depicted in FIG. 8A. At this time, by providing the taper F7 depicted in FIG. 8B, it is possible to guide the insertion of the tool 99 and make the removal work easy.

However, along with the adhesive members 53 and 54, or instead of the adhesive members 53 and 54, there may be provided, as depicted in FIG. 5, claw portions 4A and 4B for engaging with the level differences 208A and 208B in the vicinity of the boundary between the bottom surface of the housing 202 of the connector 201 and the side portions of both ends thereof.

In a state wherein the falling-off prevention device 1 is mounted to the connector 201, by inserting the second substrate 101 into the groove portion 206 of the connector 201 (and the opening 6 in the top surface of the falling-off prevention device 1), the second substrate 101 is electrically connected to the first substrate 290 via the connector 201. In this insertion process, as depicted in FIG. 9C, the inner walls 21 of the pair of protruding portions 42A and 42B in the columnar portion 2 form inner walls each having a square U-shape (or a C-shape, a U-shape, or a groove shape formed by combining two L-shape angles), and thereby guide the second substrate 101. Furthermore, once the beam member 41A of the columnar portion 2 has been fitted into the notch portion 115 of the second substrate 101, the corner portion 24A acts on the notch portion 115 and prevents the beam member 41A from coming off. Furthermore, the inner walls 22 oppositely formed by the two columnar members 45A and 45B of the columnar portion 2, act so as to press the front surface and the back surface of the substrate, respectively, and inhibit the second substrate 101 from inclining toward the arrow direction F11.

In this way, it is possible to suppress the occurrence of events of causing side effects or adverse effects, such as the increase in operational space or occupied space as in conventional falling-off prevention devices, and in addition, to prevent a falling-off between the second substrate 101 and the connector 201.

Figure 10C:
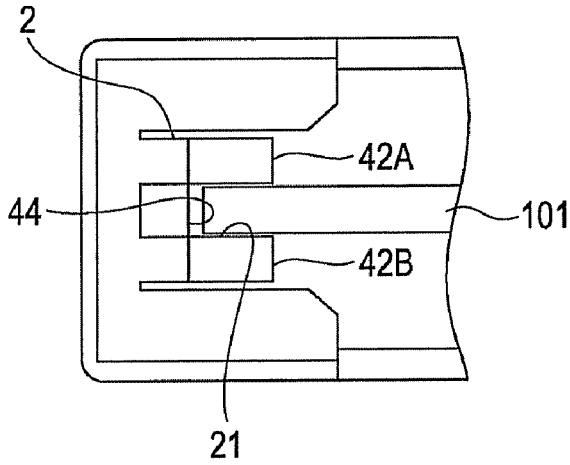
FIGS. 10A, 10B, and 10C are diagrams at the time when a columnar portion according to a second embodiment of the present invention is respectively viewed from the diagrammatically-indicated directions A1, A2, and A3.
Figure 10A:
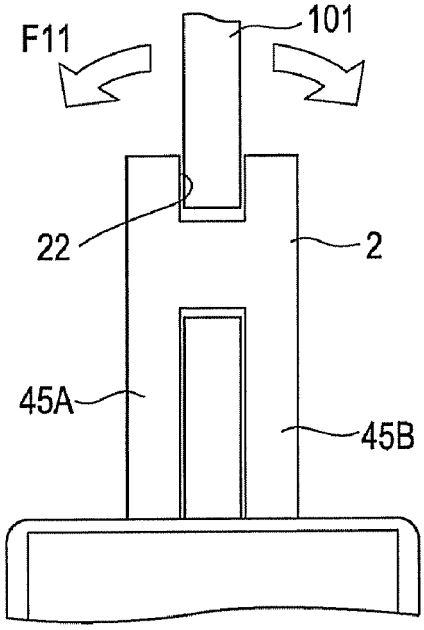
Figure 10B:
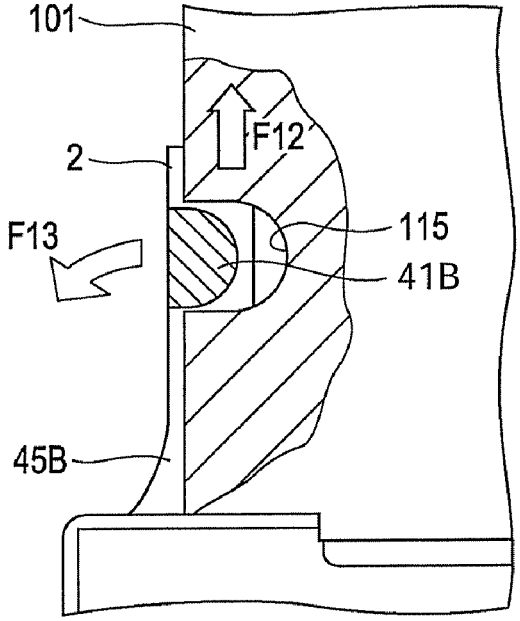

A falling-off prevention device 1 according to a second embodiment of the present invention will be described with reference to FIGS. 10A to 10C. As in the cases of FIGS. 9A to 9C. FIGS. 10A to 10C, respectively, are diagrams at the time when the columnar portion 2 is viewed from the diagrammatically indicated directions A1 to A3 (regarding the definition of the diagrammatically indicated directions, refer to FIG. 6).

The falling-off prevention device 1 according to the second embodiment has substantially the same construction as that of the first embodiment. However, as depicted in FIG. 10B, a shape of the beam member 41B to be fitted into the notch portion 115 in a section in FIG. 10 perpendicular to the diagrammatically indicated direction 2A differs from that depicted in FIG. 9B. That is, the contact portion of the section of the beam member 41 with the notch portion 115 is formed into a round shape. The bottom surface of the beam member 41, being in contact with the notch portion 115 is formed round, and has a surface structure with a curvature. When the beam member 41 having such a surface structure with a curvature makes contact with the notch portion 115, applying a load higher than a predetermined limit to the second substrate 101 in the withdrawal direction (the arrow direction F12) allows the columnar portion 2 to incline toward an arrow direction F13, thereby enabling the second substrate 101 to be withdrawn.

As in the case of the first embodiment, when the second substrate 101 is inserted into the opening 6 of the falling-off prevention device 1, the inner wall 21 formed by protruding portions 42A and 42B and the beam member 41 serves as a guide. After insertion, inclinations toward arrow directions F11 are inhibited by the inner walls 22 between the columnar members 45A and 45B. Accordingly, the falling-off prevention device 1 depicted in the first embodiment and the second embodiment can be selectively used depending on an intended use.

Figure 11C:
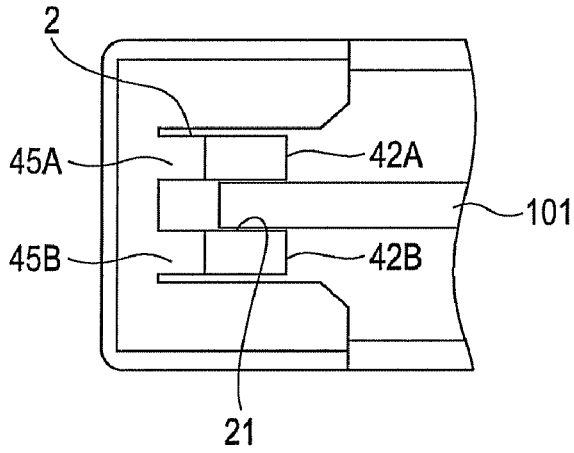
FIGS. 11A, 11B, and 11C are diagrams at the time when a columnar portion according to a third embodiment of the present invention is respectively viewed from the diagrammatically-indicated directions A1, A2, and A3.
Figure 11A:
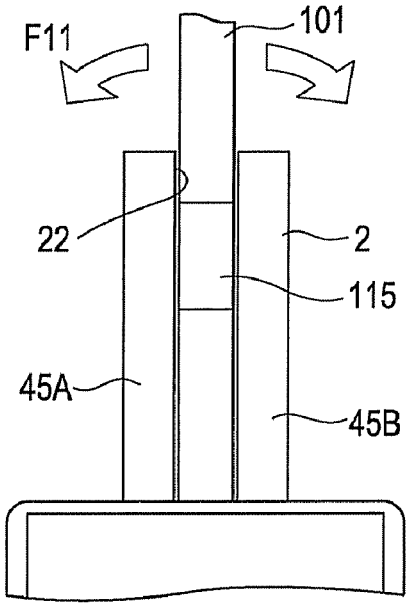
Figure 11B:
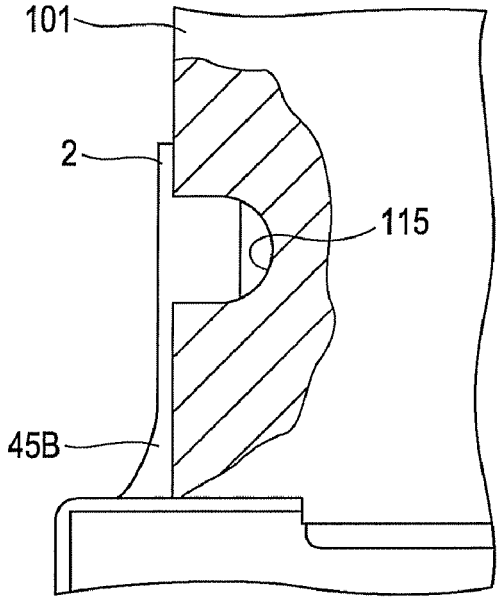

A falling-off prevention device 1 according to a third embodiment of the present invention will be described with reference to FIGS. 11A to 11C. As in the cases of FIGS. 9A to 9C, FIGS. 11A to 11C, respectively, are diagrams at the time when the columnar portion 2 is viewed from the diagrammatically indicated directions A1 to A3 (regarding the definition of the diagrammatically indicated directions, refer to FIG. 6).

The falling-off prevention device 1 according to the third embodiment has substantially the same construction as that of the first embodiment. However, in the third embodiment, the beam member 41 to be fitted into the notch portion 115 of the first embodiment does not exist as depicted in FIG. 11A and FIG. 11B. That is, the columnar portion 2 is configured so that a protruding portion 42 is added to each of the columnar members 45A and 45B independent of each other.

In this case, there is no effect of inhibiting the withdrawal of the second substrate 101 in the direction of the arrow direction F12, unlike the cases in the first embodiment (FIG. 9B) and the second embodiment (FIG. 10B). However, as in the cases of the first and second embodiments, during the insertion of the second substrate 101, the inner walls 21 formed by the protruding portions 42A and 42B of the columnar portion 2 serve as a guide. After the insertion of the second substrate 101, its inclinations toward the arrow directions F11 in FIG. 11 are inhibited by the inner walls 22 between the columnar members 45A and 45B. The second substrate 101 may be subjected to actions toward the arrow directions F11 due to mechanical resonance. The falling-off prevention device 1 according to the third embodiment has an effect of preventing such a lifting-off phenomenon due to mechanical resonance.

Figure 12A:
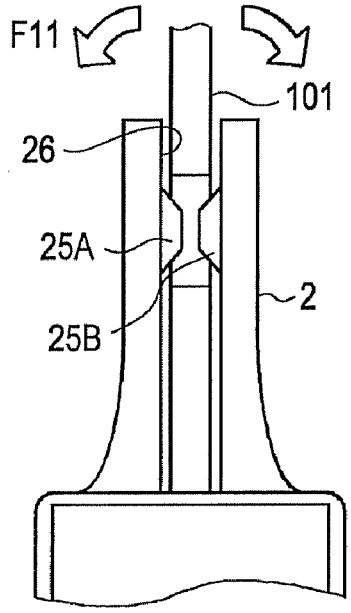
FIGS. 12A, 12B, and 12C are diagrams at the time when a columnar portion according to a fourth embodiment of the present invention is respectively viewed from the diagrammatically-indicated directions A1, A2, and A3.
Figure 12B:
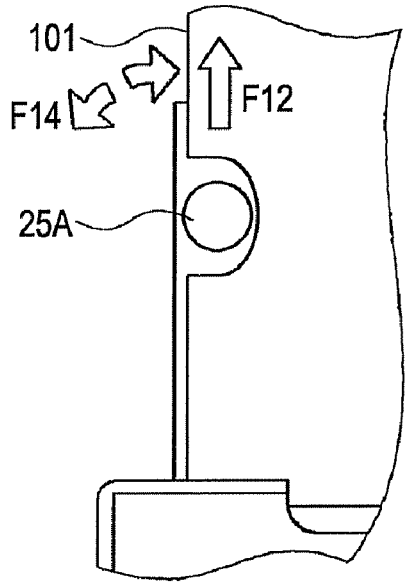
Figure 12C:
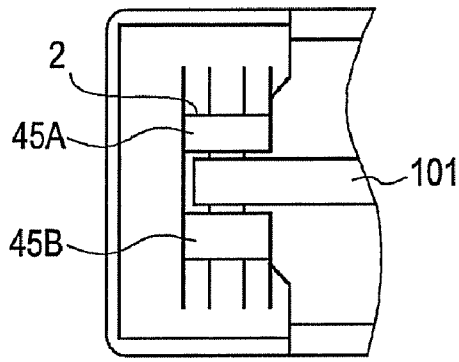

A falling-off prevention device 1 according to a fourth embodiment of the present invention will be described with reference to FIGS. 12A to 12C. As in the cases of FIGS. 9A to 9C. FIGS. 12A to 12C, respectively, are diagrams at the time when the columnar portion 2 is viewed from the diagrammatically indicated directions A1 to A3 (regarding the definition of the diagrammatically indicated directions, refer to FIG. 6).

The falling-off prevention device 1 according to the fourth embodiment has substantially the same construction as that of the third embodiment. As in the case of the third embodiment, the beam member 41 connecting the columnar members 45A and 45B does not exist in the fourth embodiment. That is, the columnar portion 2 is configured to have the columnar members 45A and 45B independent of each other. However, in the fourth embodiment, instead of the protruding portions 42A and 42B in the third embodiment, as depicted in FIGS. 12A and 12B, the opposing projecting members 25A and 25B to be fitted in the notch portion 115 are provided to the columnar members 45A and 45B, respectively, in the columnar portion 2. That is, on opposing surfaces where the columnar members 45A and 45B oppose each other, the opposing projecting members 25A and 25B that project in a chevron shape (or round shape) are provided, respectively.

After the insertion of the second substrate 101 into the connector 201 (and the falling-off prevention device 1), as depicted in FIG. 12A, opposing inner walls 26 of the columnar members 45A and 45B press the second substrate 101 to inhibit it from inclining toward the arrow direction F12.

As depicted in FIG. 12B, the opposing projecting members 25A and 25B each has a structure of which the section has a semicircular contour. The opposing projecting members 25A and 25B are fitted into a space formed in the notch portion 115, thereby inhibiting the second substrate 101 from being withdrawn.

When load higher than a predetermined limit is applied to the second substrate 101 in the arrow direction F12, the opposing projecting members 25A and 25B open toward the arrow directions F11 in FIG. 12A, to thereby allow the second substrate 101 to be withdrawn. However, the construction of the fourth embodiment is superior in the resistance to inclinations toward the directions F14 during the withdrawal of the falling-off prevention device 101.

Figure 13A:
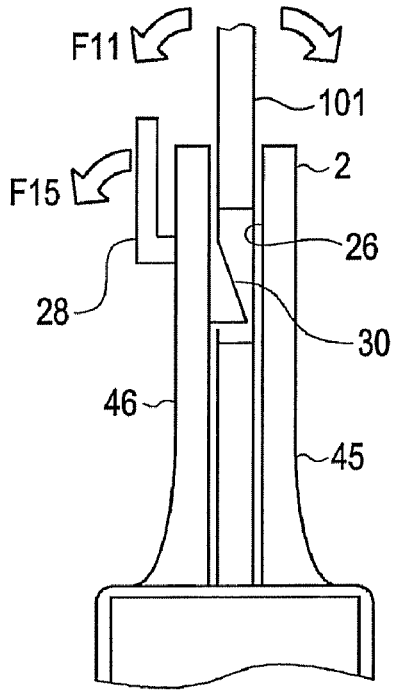
FIGS. 13A, 13B, 13C, and 13D are diagrams at the time when a columnar portion according to a fifth embodiment of the present invention is respectively viewed from the diagrammatically-indicated directions A1, A2, and A3.
Figure 13B:
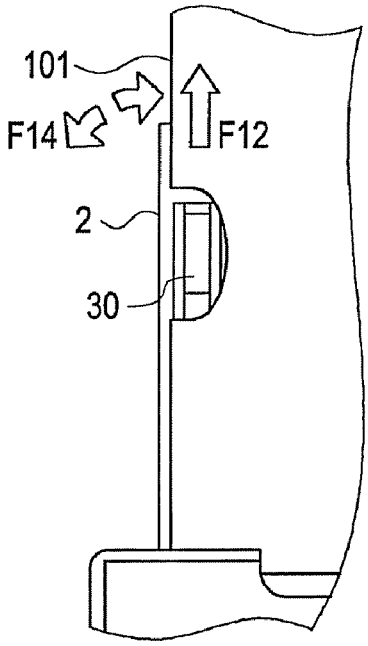
Figure 13C:
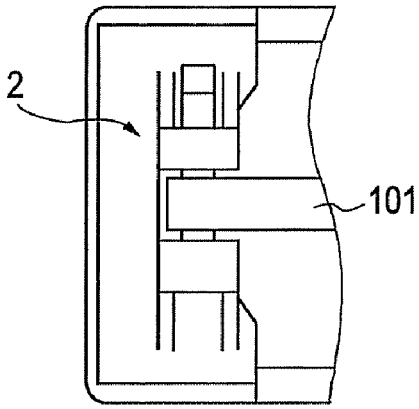
Figure 13D:
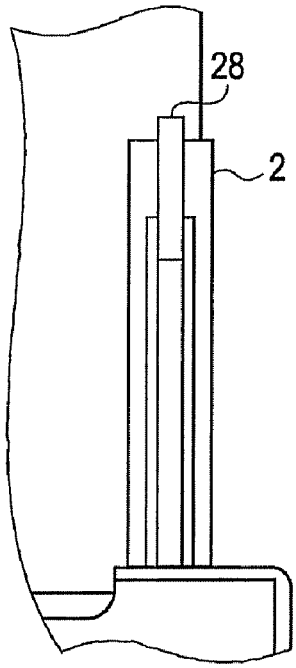

A falling-off prevention device 1 according to a fifth embodiment of the present invention will be described with reference to FIGS. 13A to 13D. As in the cases of FIGS. 9A to 9C, FIGS. 13A to 13C, respectively, are diagrams at the time when the columnar portion 2 is viewed from the diagrammatically indicated directions A1 to A3. On the other hand, FIG. 13D is a diagram at the time when the columnar portion 2 is viewed from the diagrammatically indicated directions A4 (regarding the definition of the diagrammatically indicated directions, refer to FIG. 6).

The falling-off prevention device 1 according to the fifth embodiment has substantially the same construction as that of the fourth embodiment. As in the case of the fourth embodiment, also in the fifth embodiment, the columnar portion 2 has columnar members 45 and 46 independent of each other, and the beam member 41 connecting the columnar members 45 and 46 does not exist. However, the fifth embodiment differs from the fourth embodiment in that a single projecting portion 30 to be fitted into the notch portion 115 is provided in only one of the columnar members e.g., the columnar member 46 as depicted in FIGS. 13A and 13B, while in the fourth embodiment, the opposing projecting members 25A and 25B are provided (FIGS. 12A and 12B). Moreover, as depicted in FIG. 13A, the fifth embodiment differs from the fourth embodiment in that there is provided a grip portion 28 for inclining the columnar member 46 during the withdrawal of second substrate 101, as depicted in FIG. 13A.

That is, in the fifth embodiment, out of the two columnar members 45 and 46, one (for example, the columnar member 46 in the case of FIG. 13A) is provided with the single projecting portion 30 of which the section has a wedge shape. The single projecting portion 30 has a flat portion on the bottom surface. Accordingly, when a withdrawal force is applied to the second substrate 101 toward the arrow direction F12 after the insertion of the second substrate 101 into the connector 201 (and the falling-off prevention device 1), the single projecting portion 30 presses the notch portion 115. Since the bottom surface of the single projecting portion 30 is of a planar structure, it inhibits the second substrate 101 from lifting off.

When attempting to withdraw the second substrate 101, the grip portion 28 is inclined toward the arrow direction F15 until the single projecting portion 30 becomes disengaged, to thereby pull out the second substrate 101. The construction of the fifth embodiment is superior in the resistance to inclinations toward the arrow directions F14 (refer to FIG. 13B) during the withdrawal of the falling-off prevention device 101. Since, there exists no beam member in the fifth embodiment, unlike in the case of the first embodiment, even if mechanical oscillations occur to the second substrate 101 to thereby cause oscillations in the direction in which the columnar portion 2 is twisted (i.e., moment in the arrow directions F14), there is a high possibility that the oscillations do not act on the columnar portion 2.

Figure 14:
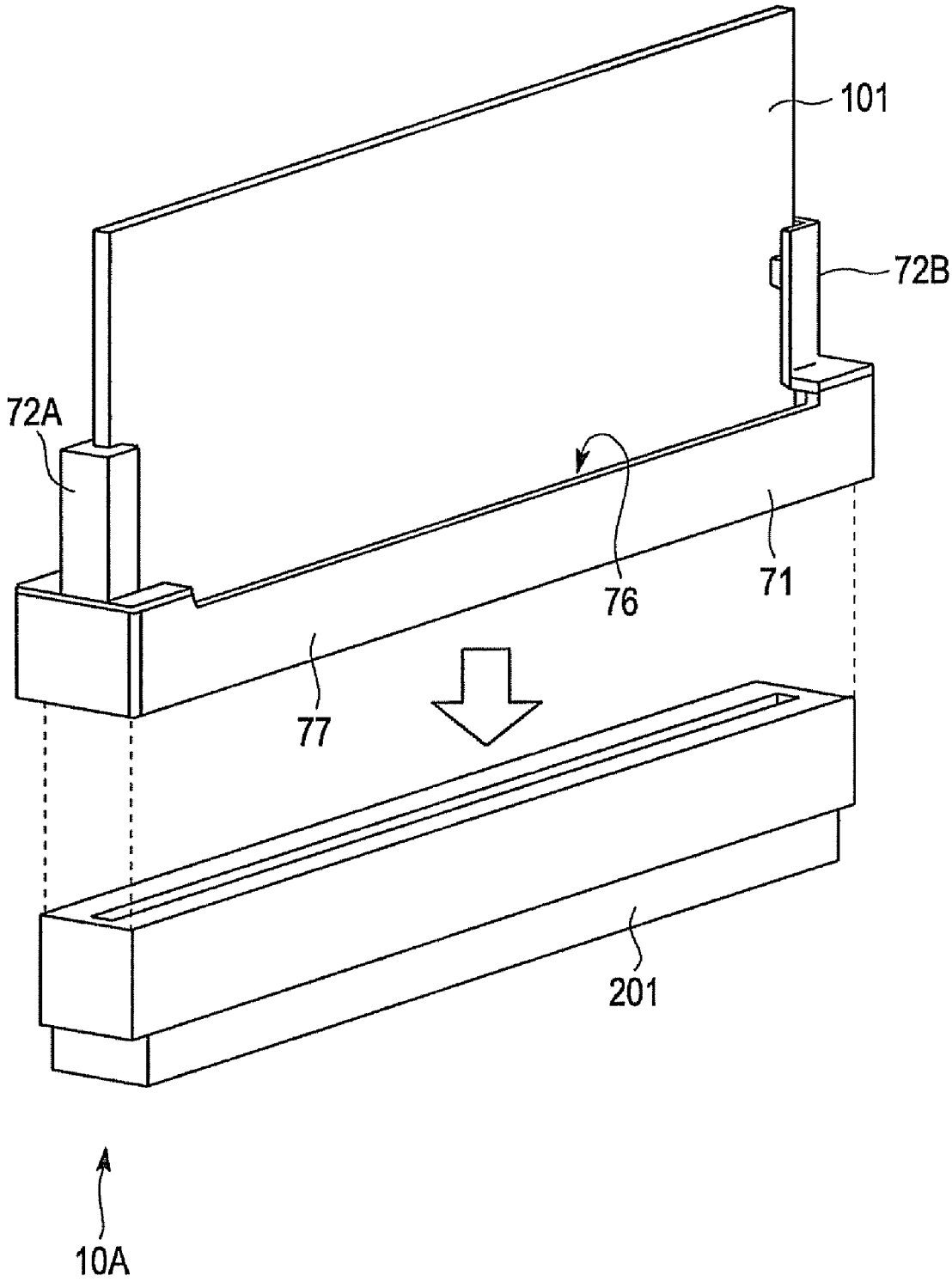
FIG. 14 is a diagram depicting an example of a schematic configuration of an electronic device according to a sixth embodiment.

An electronic device 10A and a falling-off prevention device 71 according to a sixth embodiment will be described with reference to FIGS. 14 to 16. FIG. 14 is a diagram depicting a schematic configuration of the electronic device 10A. In the above-described first to fifth embodiments, the falling-off prevention device 1 is fixed to the connector 201, and thereafter the second substrate 101 is mounted to the connector 201. In the sixth embodiment, the falling-off prevention device 71 is mounted to the connector 201 after having been fixed to the second substrate 101. Other configurations and effects are the same as those in the first to fifth embodiments. As in the cases of the first to fifth embodiments, the falling-off prevention device 71 can be also produced by molding resin. In FIG. 14, conductive patterns, contacts and the like of the second substrate 101 are omitted.

As depicted in FIG. 14, the falling-off prevention device 71 is fitted into the connector 201 after having been fixed to the second substrate 101. Here, the first substrate 290 (refer to FIG. 4) to which the connector 201 is to be mounted is omitted. The falling-off prevention device 71 includes a boxy base portion 77 that is narrow in a direction of lower-end edge of the second substrate 101, and a pair of support portions 72A and 72B erecting from the top surface at both ends of the base portion 77 and supporting the second substrate 101 from the side.

As in the cases of the first to fifth embodiments, the base portion 77 has a boxy shape, and is provided with an opening 76 penetrating from the top surface down to the bottom surface. The pair of support portions 72A and 72B are disposed on both sides of the opening 76, on the top surface of the base portion 77.

Figure 15:
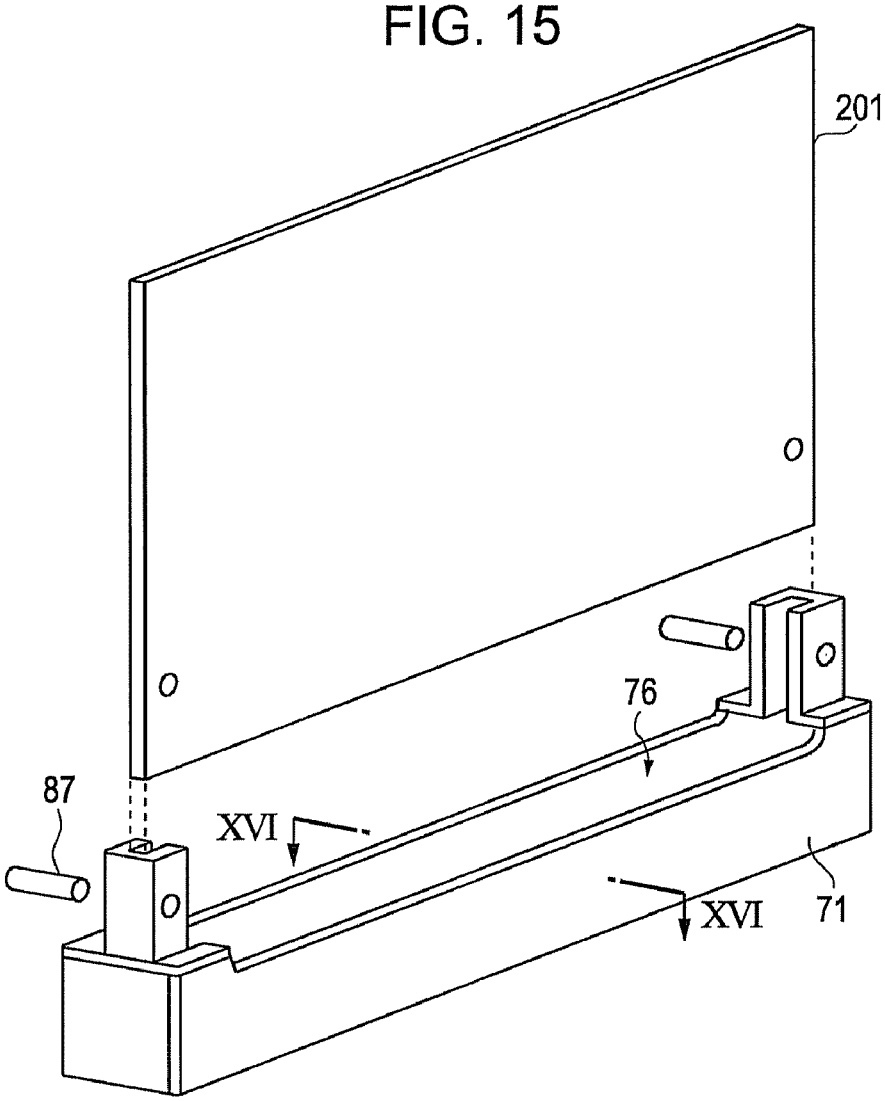
FIG. 15 is a diagram depicting an example of a method for connecting electronic devices.

FIG. 15 depicts details of an exemplary method for fixing the second substrate 101 to the falling-off prevention device 71. After having covered the second substrate 101 with the falling-off prevention device 71, spring pins are pressed into openings provided in the connector 201 and the falling-off prevention device 71 for fixing.

Figure 16:
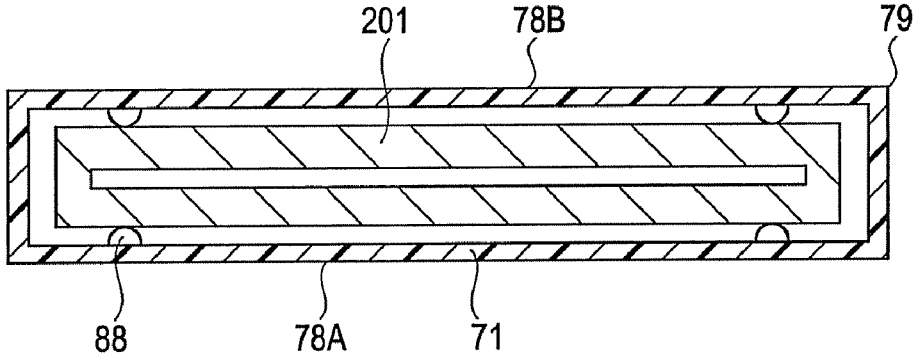
FIG. 16 is a diagram depicting an example of a coming-off prevention device between the connector and the falling-off prevention structure.

In FIG. 16, a falling-off prevention structure between the falling-off prevention device 71 and the connector 201 is depicted. FIG. 16 is a sectional view at the time when falling-off prevention device 71 is taken away along a line XVI-XVI in FIG. 15. When the connector 201 is inserted into the falling-off prevention device 71, a protrusion 88 for clamping, provided on the inner peripheral surface of the falling-off prevention device 71, slides against the outer peripheral portion. After the sliding, a frictional force occurs between the protrusion 88 and the outer peripheral portion of the connector 201. By virtue of this frictional force, the second substrate 101 covered with the falling-off prevention device 71 is retained by the connector 201. That is, stress directed from the falling-off prevention device 71 toward the connector 201 concentrates on the protrusion 88. Preferably, the location of the protrusion 88 is nearer to the center of the front side portion 78A and back side surface than the location of the projection portions 5, being away from the corner portion 79. This is because the protrusion 88 is intended for preventing falling-off between the falling-off prevention device 71 and the connector 201, i.e., for generating a frictional force, and not intended for ensuring a clearance.

Figure 17:
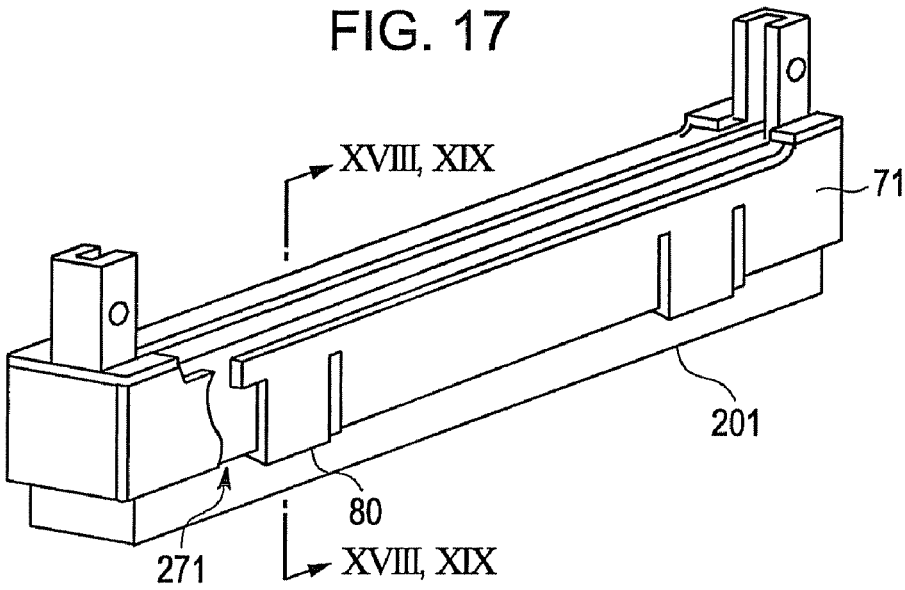
FIG. 17 is a perspective view depicting another example of coming-off prevention device between the connector and the falling-off prevention structure.
Figure 18:
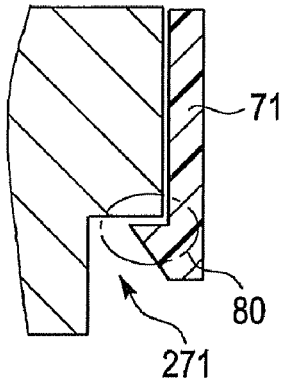
FIG. 18 is a perspective view depicting still another example of coming-off prevention device between the connector and the falling-off prevention structure.
Figure 19:
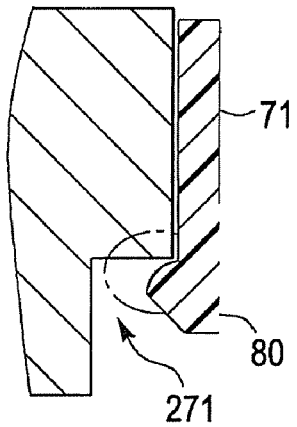
FIG. 19 is a perspective view depicting a further example of falling-off prevention device between the connector and the falling-off prevention structure.

FIG. 17 depicts another example of falling-off prevention structure between the falling-off prevention device 71 and the connector 201. FIGS. 18 and 19 are each a sectional view (partially enlarged view) at the time when the falling-off prevention device 71 is taken away along a line XVIII, XIX- XVIII, XIX in FIG. 17. In FIG. 18, the vicinities of a level difference 271 and claw portion 80 is illustrated in an enlarged manner. In this example, as depicted in FIGS. 17 and 18, the falling-off prevention device 71 has a claw portion 80. On the other hand, in the vicinity of a ridge line at the boundary between the bottom surface of the connector 201 and the front side portion 8A, and in the vicinity of a ridge line at the boundary between the bottom surface of the connector 201 and the back side portion 8B, there is provided a level difference 271. The falling-off prevention device 71 is arranged so that the claw portion 80 is engaged with the level difference 271 of the connector 201 when the falling-off prevention device 71 fixed to the second substrate 101 is caused to cover the connector 201. That is, by the claw portion 80 being locked by the level difference 271, a falling-off prevention function is exerted.

The pressing force to be exerted on the second substrate 101 can be adjusted according to the shape of claw portion 80. For instance, in the example in FIG. 18, unless the engagement of the claw portion 80 with the level difference 271 is released, the falling-off prevention device 71 fixed to the second substrate 101 cannot be withdrawn from the connector 201 even if the second substrate 101 is only pulled up. That is, in the example in FIG. 18, the claw portion 80 is engaged with the level difference 271 by a plane or a surface with an acute angle, thereby producing a strong falling-off prevention effect.

FIG. 19 depicts another example of claw portion. In the example in FIG. 19, the claw portion 81 is engaged with the level difference 271 by a surface with an obtuse angle or a surface with a curvature. In this case, pulling up the second substrate 101 by a force above a certain level, allows it to be withdrawn. Accordingly, the claw portion 80 in FIG. 18 and the claw portion 81 in FIG. 19 can be selectively used depending on an intended use.

Figure 20:
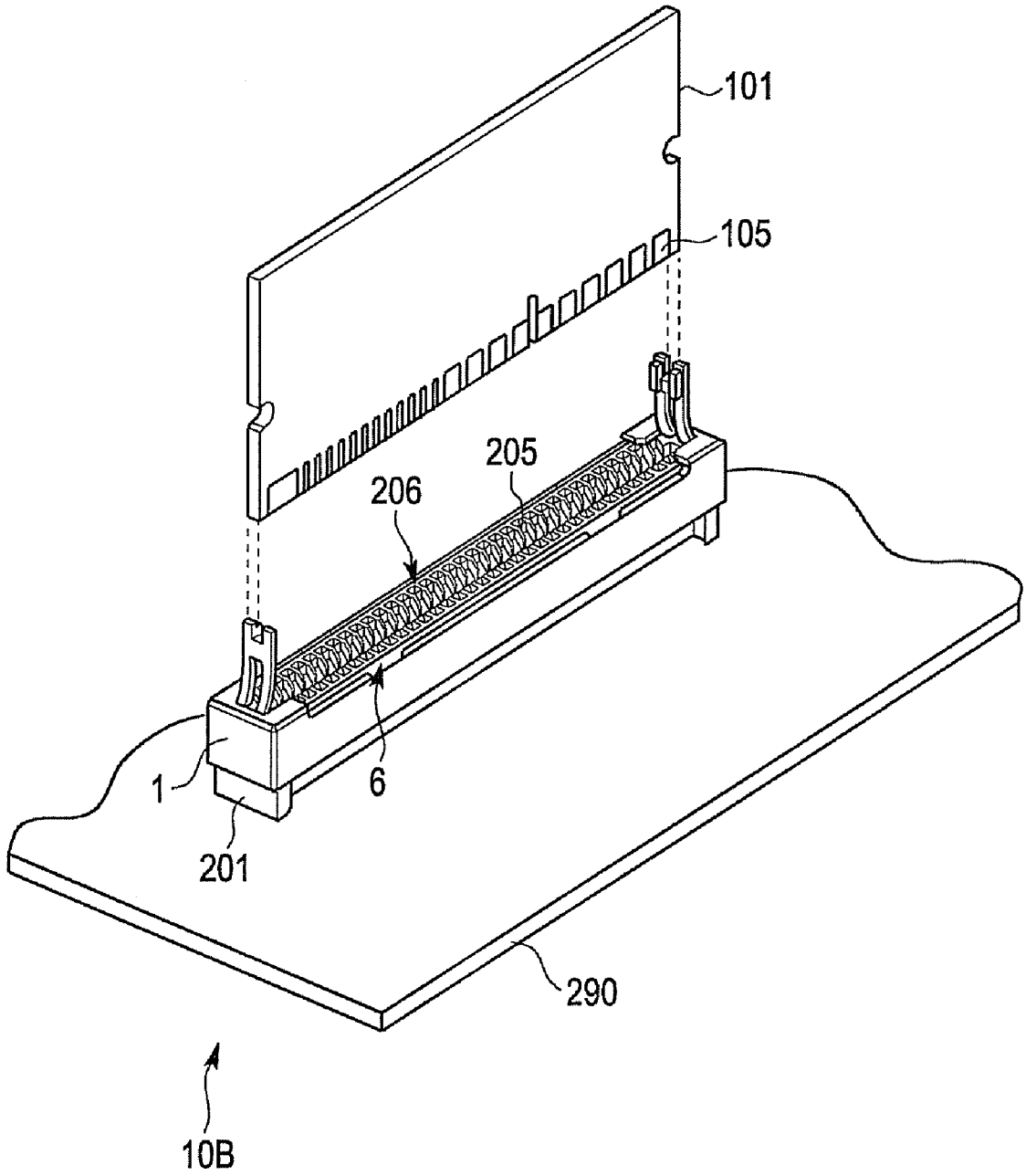
FIG. 20 is a perspective view depicting a constructional example of an electronic device equipped with the falling-off prevention device.
Figure 21:
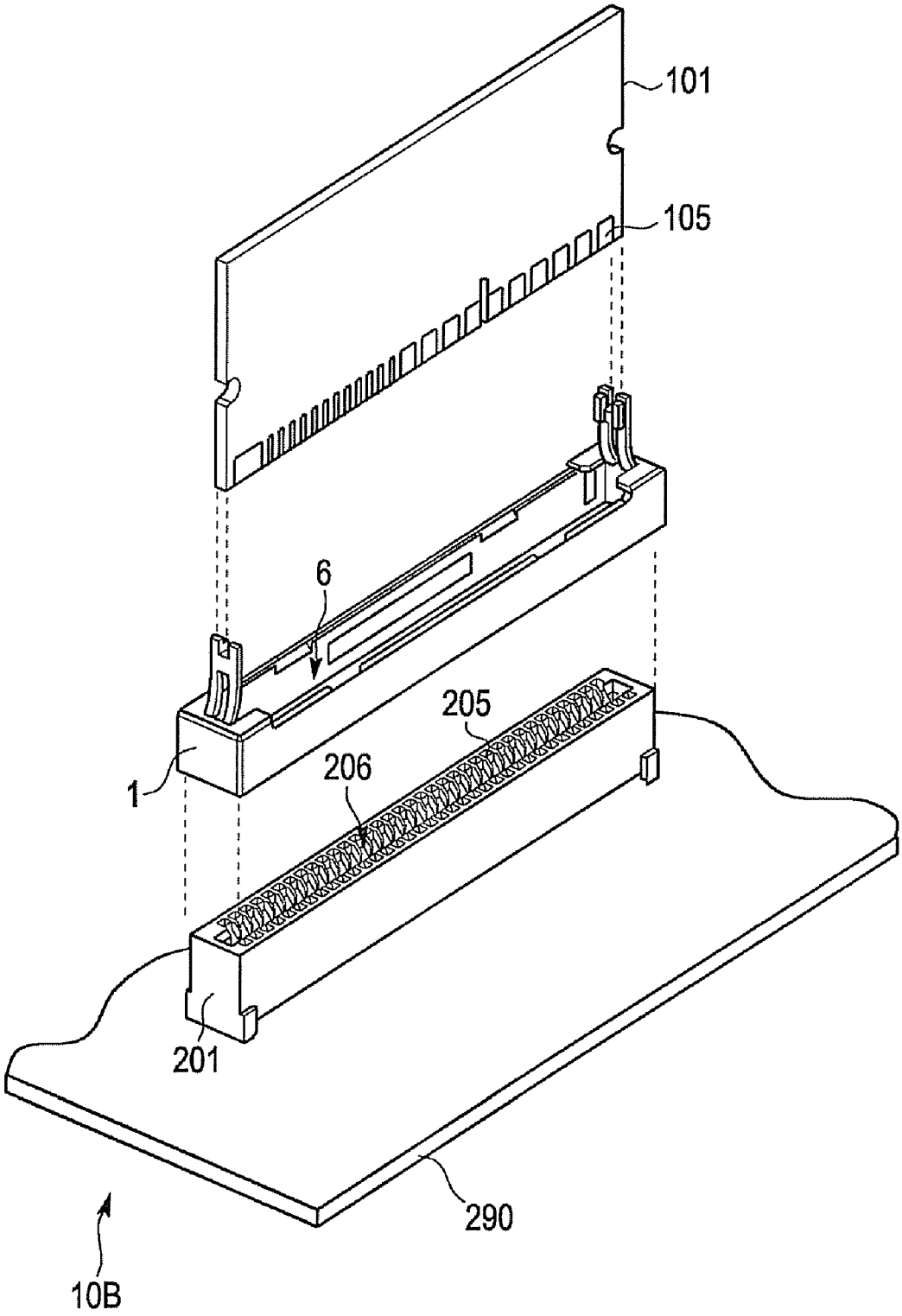
FIG. 21 is a perspective view depicting a state of an electronic device before being equipped with the falling-off prevention device.

FIGS. 20 and 21 depict examples of the overall configuration of an electronic device 10B. FIG. 20 is a perspective view depicting a configuration example of the electronic device 10 to which the falling-off prevention device 1 has been mounted. FIG. 21 is a perspective view depicting a state before the falling-off prevention device is mounted to the electronic device 10B. The electronic device 10B includes a first substrate 290, a connector 201 arranged on the first substrate 290, a falling-off prevention device 1 covering the connector 201, and a second substrate 101 to be fitted into a groove portion through the opening 6 of the falling-off prevention device 1.

As described above, the first substrate 290 is, for example, a mother board, and the substrate surface is provided with a large number of components including the connector 201. Conductive patterns are provided on the substrate surface, and electrically connect components to each other, on the substrate surface.

Within the groove portion 206 of the connector 201, a large number of contacts 205 (corresponding to connector-side terminals) are arranged, and connected to conductive patterns on the first substrate 290. On the other hand, also on the second substrate 101, a large number of components are arranged and electrically connected to one another by conductive patterns. Also in the vicinity of the lower end of the second substrate 101, contacts (corresponding to substrate-side terminals) are arranged. By fitting the lower end of the second substrate 101 into the groove portion 206 of the connector 201, the conductive patterns of the first substrate 290 and those of the second substrate 101 are electrically connected, thus constituting the electronic device 10B.

To the electronic device 10B depicted in FIG. 20, the falling-off prevention device 1 depicted in any of the embodiments 1 to 5 is applied. Alternatively, the falling-off prevention device 71 of the sixth embodiment may be used instead of the falling-off prevention device 1.

Further, according to an aspect of the embodiments, any combinations of the described features, functions and/or operations can be provided.

The many features and advantages of the embodiments are apparent from the detailed specification and, thus, it is intended by the appended claims to cover all such features and advantages of the embodiments that fall within the true spirit and scope thereof. Further, since numerous modifications and changes will readily occur to those skilled in the art, it is not desired to limit the inventive embodiments to the exact construction and operation illustrated and described, and accordingly all suitable modifications and equivalents may be resorted to, falling within the scope thereof.

What is claimed is:

1. A substrate fixing member that fixes a substrate having mutually opposing end portions to a connector by covering the connector, the substrate fixing member comprising:

a fixing member main body portion that covers a top surface portion of the connector having an insertion hole, and has a through-hole that the substrate is to be passed through;

a substrate support portion that extends from the main body portion in a direction of the insertion of the substrate and has a groove portion slidably holding the end portions of the substrate when the substrate is passed through the through-hole and the insertion hole to connect a substrate-side connection terminal to a connector-side terminal;

an interference portion that is formed on an inner wall surface of the substrate fixing member opposing a long side surface of the connector and that forms a space between the outer surface of a main body of the connector and the inner wall surface of the substrate fixing member by interfering with the main body of the connector when the substrate is passed through the through-hole and the insertion hole to connect the substrate-side connection terminal to the connector-side terminal; and an adhesive member that adheres the inner wall surface of the substrate fixing member to an outer surface of the connector.

2. The substrate fixing member according to claim 1, wherein the connector further comprises:

a locking receiving portion that is formed on a short side surface of the connector and shares a short side of a top surface with the top surface; and the substrate fixing member further comprises:

a locking portion that is formed on an inner wall surface opposing the short side surface of the connector and fits into the locking receiving portion.

3. The substrate fixing member according to claim 1, wherein the substrate further comprises:

a notch portion that is formed at the end portions; and the substrate fixing member further comprises:

a pressing portion that is formed in the groove portion of the substrate support portion and that presses the notch portion.

4. A substrate fixing member that fixes a substrate having mutually opposing end portions to a connector by covering the connector, the substrate fixing member comprising:

a fixing member main body portion that covers a top surface portion of the connector having an insertion hole, and has a through-hole that the substrate is to be passed through;

a substrate support portion that extends from the main body portion in a direction of the insertion of the substrate and has an insert portion to be inserted into a space formed in a notch portion provided at the end portions of the substrate when the substrate is passed through the through-hole and the insertion hole to connect a substrate-side connection terminal of the substrate to a connector-side terminal;

an interference portion that is formed on an inner wall surface of the substrate fixing member opposing a long side surface of the connector and that forms a space between the outer surface of a main body of the connector and the inner wall surface of the substrate fixing member by interfering with the main body of the connector when the substrate is passed through the through-hole and the insertion hole to connect the substrate-side connection terminal to the connector-side terminal; and an adhesive member that adheres the inner wall surface of the substrate fixing member to an outer surface of the connector.

5. An electronic device, comprising:

a printed circuit board on which a component is arranged;

a substrate that is arranged on the printed circuit board and that is electrically connected to the component and has mutually opposing end portions;

a connector that has an insertion hole into which the substrate is to be inserted; and a substrate fixing member that fixes the substrate by covering the connector, the substrate fixing member comprising:

a fixing member main body portion that covers a top surface portion of the connector, and has a through-hole that the substrate is to be passed through;

a substrate support portion that extends from the main body portion in a direction of the insertion of the substrate and has a groove portion slidably holding the end portions of the substrate when the substrate is passed through the through-hole and the insertion hole to connect a substrate-side connection terminal to a connector-side terminal;

an interference portion that is formed on an inner wall surface of the substrate fixing member opposing a long side surface of the connector and that forms a space between the outer surface of a main body of the connector and the inner wall surface of the substrate fixing member by interfering with the main body of the connector when the substrate is passed through the through-hole and the insertion hole to connect the substrate-side connection terminal to the connector-side terminal; and an adhesive member that adheres the inner wall surface of the substrate fixing member to an outer surface of the connector.

6. The electronic device according to claim 5, wherein the connector further comprises:

a locking receiving portion that is formed on a short side surface of the connector, and shares a short side of a top surface with the top surface; and the substrate fixing member further comprises:

a locking portion that is formed on an inner wall surface opposing the short side surface of the connector and fits into the locking receiving portion.

7. The electronic device according to claim 6, wherein the end portion on the top surface side of the inner wall surface is chamfered.

8. The electronic device according to claim 5, wherein the substrate further comprises:

a notch portion that is formed at the end portions; and the substrate fixing member further comprises:

a pressing portion that is formed in a groove portion in the substrate support portion, and presses the notch portion.

9. An electronic device comprising:

a printed circuit board on which components are arranged;

a substrate that is arranged on the printed circuit board and is electrically connected to the components, and has mutually opposing end portions;

a connector that has an insertion hole into which the substrate is to be inserted; and a substrate fixing member that fixes the substrate by covering the connector, the substrate fixing member comprising:

a fixing member main body portion that covers a top surface portion of the connector, and has a through-hole that the substrate is to be passed through;

a substrate support portion that extends from the main body portion in a direction of the insertion of the substrate and has an insert portion to be inserted into a space formed in a notch portion provided at an end portion of the substrate when the substrate is passed through the through-hole and the insertion hole to connect a substrate-side connection terminal to a connector-side terminal;

an interference portion that is formed on an inner wall surface of the substrate fixing member opposing a long side surface of the connector and that forms a space between the outer surface of a main body of the connector and the inner wall surface of the substrate fixing member by interfering with the main body of the connector when the substrate is passed through the through-hole and the insertion hole to connect the substrate-side connection terminal to the connector-side terminal; and an adhesive member that adheres the inner wall surface of the substrate fixing member to an outer surface of the connector.

* * * * *